United States Patent [19]

Link et al.

[11] Patent Number: 4,470,027

[45] Date of Patent: Sep. 4, 1984

[54] MOLDED CASE CIRCUIT BREAKER WITH IMPROVED HIGH FAULT CURRENT INTERRUPTION CAPABILITY

[75] Inventors: Donald A. Link, Hubertus; John A. Swessel, Jr., Milwaukee; Peter J. Theisen, West Bend, all of Wis.

[73] Assignee: Eaton Corporation, Cleveland, Ohio

[21] Appl. No.: 399,086

[22] Filed: Jul. 16, 1982

[51] Int. Cl.[3] ..... H01H 77/02

[52] U.S. Cl. ..... 335/16

[58] Field of Search ..... 335/16, 147, 195

[56] References Cited

U.S. PATENT DOCUMENTS

| | | | |
|---|---|---|---|
| 1,720,566 | 7/1929 | Pestarini . | |
| 3,492,609 | 1/1970 | Murai et al. . | |
| 3,815,059 | 6/1974 | Spoelman . | |
| 4,077,025 | 2/1978 | Slade et al. . | |
| 4,149,129 | 4/1979 | Andersen et al. . | |
| 4,220,934 | 9/1980 | Wafer et al. | 335/16 |
| 4,255,732 | 3/1981 | Wafer et al. . | |
| 4,278,958 | 7/1981 | Kandatsu | 335/16 |
| 4,286,130 | 8/1981 | Troebel . | |

*Primary Examiner*—J. D. Miller
*Assistant Examiner*—George Andrews
*Attorney, Agent, or Firm*—L. G. Vande Zande; C. H. Grace

[57] ABSTRACT

A contact structure (40, 44; 62, 63) is arranged to provide oppositely directed parallel current paths within a closed loop magnetic flux amplifier (46) to be directly separable under high overload current conditions, the flux amplifier (46) functioning to arrest the movable contact (62, 63) momentum. Manufacturing economies are realized by subassembling the stationary contact structure (40, 42, 44) and flux amplifier (46) and subsequently trapping one end (42*a*) of that assembly within the base (4*a*) and securing the other end with a single screw (68). The movable contact arm (62) comprises a plurality of blanked laminations assembled to provide improved contact (63) mounting and bearing (62*d*) surfaces. The molded case sidewalls are strengthened in the contact separation area by offsetting the parting line (PL) between cover (6) and base (4) closer to the bottom of base (4) and overlapping the thinner base sidewalls with thicker cover sidewalls at the offset (4*e*, 6*e*).

22 Claims, 11 Drawing Figures

6
6
2
4
6
6a
6b
8
10
12
14
16
18
20
22
24
30
32
34
36
38
40
42
42a
44
46
48a
48b
50
52
54
56
58
60
60a
60b
62
62a
62b
63
64
66
68
70
72
74
76
78
80
82
84
86
88
90
PL
PL

Fig. 6
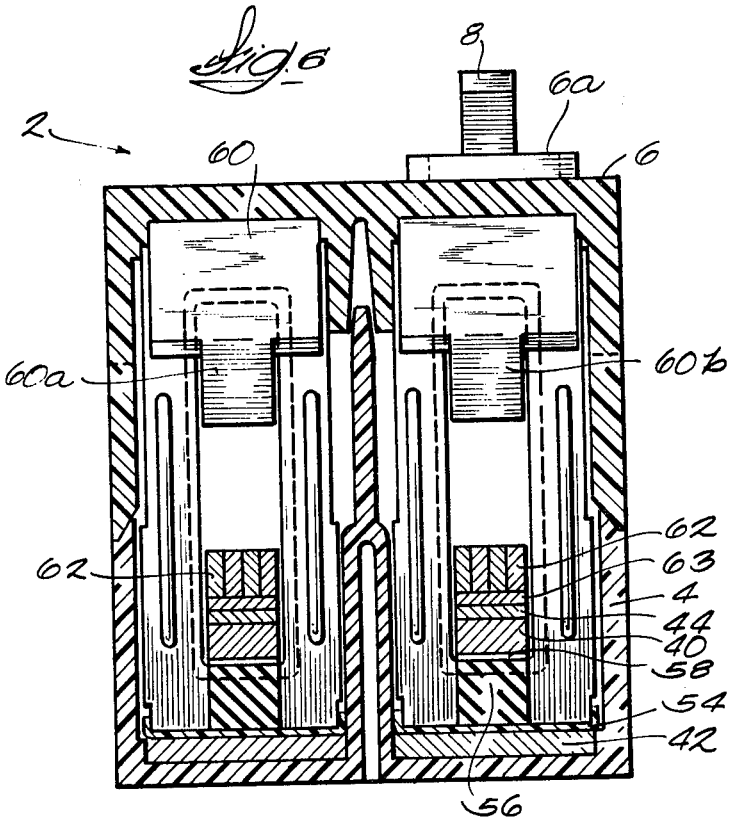
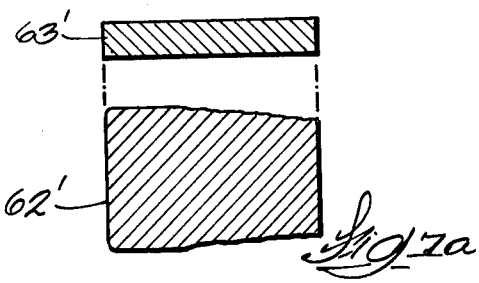
Fig. 7a
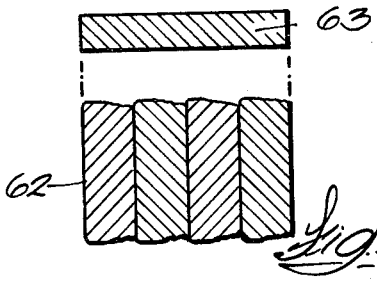
Fig. 7b

MOLDED CASE CIRCUIT BREAKER WITH IMPROVED HIGH FAULT CURRENT INTERRUPTION CAPABILITY

BACKGROUND OF THE INVENTION

This invention relates to molded case circuit breakers operable upon high fault currents to limit the peak let-through current.

Circuit breakers of this type are generally known which employ separable contacts supported in a manner to direct the current flow through the contact support members in opposite directions whereby electromagnetic forces generated by these currents operate to separate the contacts independently of the circuit breaker operating mechanism. The contact structure is designed to quickly separate the contacts during a high fault current condition to rapidly lengthen the arc generated between the contacts, thereby to rapidly raise the arc voltage. Magnetic devices are utilized to amplify the flux and the electromagnetic forces generated by the currents in the contact support members to thereby enhance the separating movement of the contacts. These magnetic amplifiers are generally U-shaped structures of magnetizable material disposed around the supporting elements for the separable contacts.

A problem associated with molded case circuit breaker design is the ability to package a contact structure having a desired current interruption capacity into a molded case having specific dimensional constraints. For example, 600 volt industrial frame molded case circuit breakers of the aforementioned type are known which have one or more pairs of cooperating separable contacts each pivotally mounted for movement in opposite directions to increase the relative separation rate therebetween. While this approach is satisfactory for industrial frame breakers, the vertical space requirements for a contact structure of this type render it unsatisfactory for use in 240/250 volt residential and commercial frame molded case circuit breakers which are intended to mount within flush mounted panelboards located in dwelling studwalls.

Another problem associated with high current interrupting molded case circuit breakers is the ability of the molded case to withstand the shock forces associated with arresting the movement of the contacts under high fault current separation and the forces exerted on sidewalls of the case by internal pressure developed by gasses as a result of an arc established during contact separation. The invention disclosed herein relates to improvements in molded case circuit breakers which particularly address the aforementioned and other problems.

SUMMARY OF THE INVENTION

This invention provides a molded case circuit breaker having a low profile suitable for residential and commercial frame application and having contacts which are separable independently of the breaker operating mechanism upon high fault current conditions. The circuit breaker of this invention employs oppositely directed current paths in the contact members in conjunction with a closed-loop magnetic flux amplifier for amplifying the flux and electromagnetic forces developed in the contact members over a higher range of current values than is obtainable with an open-slotted flux amplifier. The flux amplifier of this invention also functions as a means for arresting the separating movement of the contact members, thereby utilizing proportionate electromagnetic forces induced in the flux amplifier to counteract the momentum of the separating contact members. The flux amplifier and one of the contact members are assembled as a separate unit or subassembly to facilitate assembly of the circuit breaker and reduce manufacturing costs thereof. The molded case for the circuit breaker has an offset parting line between the base and cover thereof and an overlapping structural configuration of the cover with respect to the base in the contact separation area to increase the strength of the molded case and its ability to withstand the forces generated by the arc gasses upon contact separation.

The invention and its advantages will become more apparent in the following description of the preferred embodiments when read in conjunction with the accompanying drawings.

BRIEF DESCRIPTION OF THE DRAWINGS

FIG. 6 is a lateral cross-section of the circuit breaker taken substantially along the line 6—6 in FIG. 3;

Figure 8:
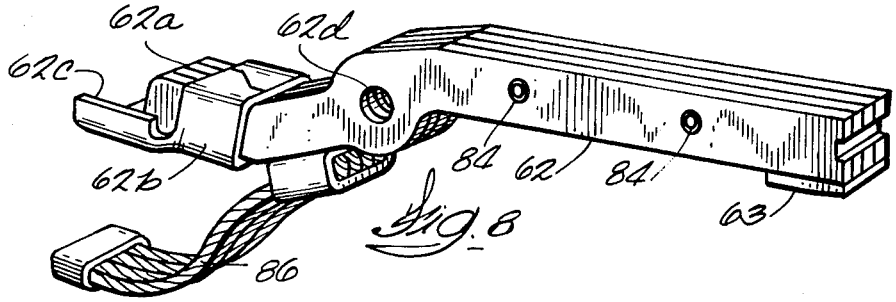
Figure 9:
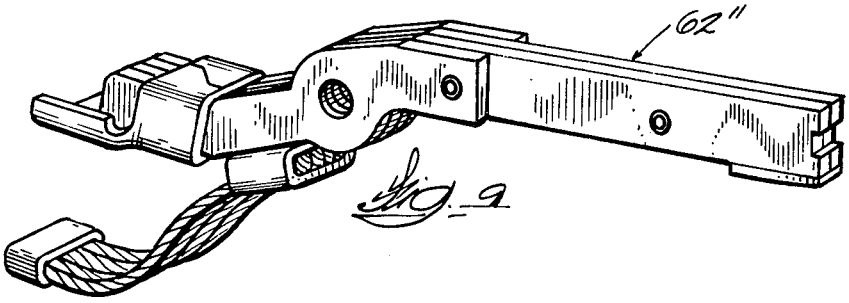

FIGS. *7a* and *7b* are views illustrating a problem associated with construction of the movable contact assembly and a preferred construction thereof which solves the problem, respectively;

FIG. 8 is a perspective view of the movable contact assembly for the circuit breaker of this invention;

FIG. 9 is a perspective view of a modified movable contact assembly; and

Figure 10:
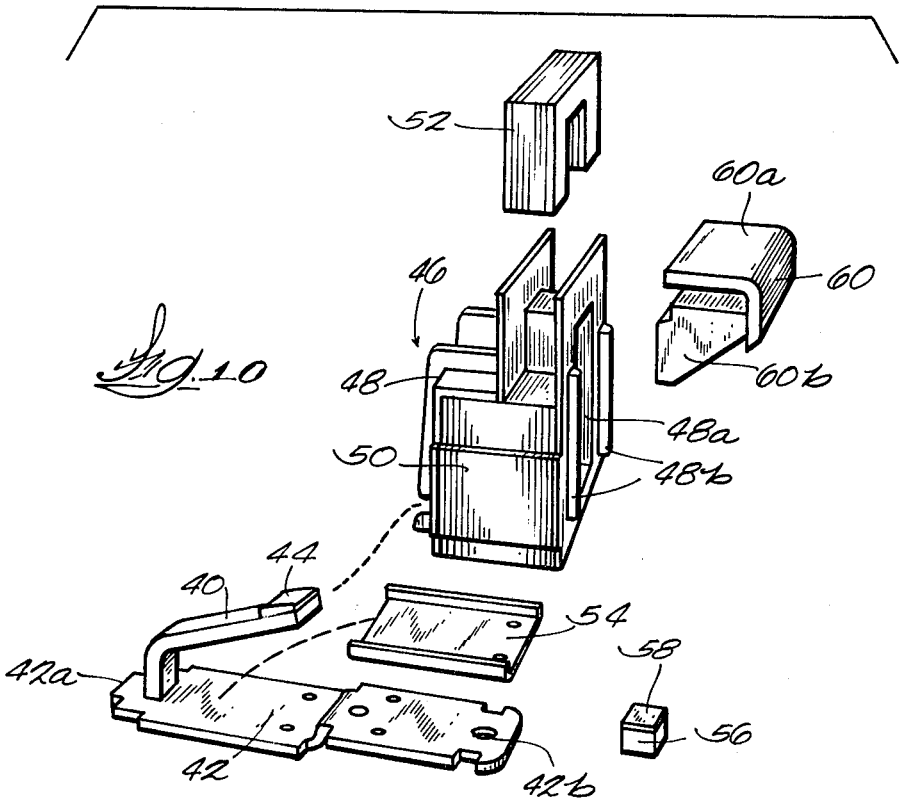

FIG. 10 is an exploded perspective view of the flux amplifier and stationary contact subassembly for the circuit breaker of this invention.

DESCRIPTION OF THE PREFERRED EMBODIMENT

Figure 1:
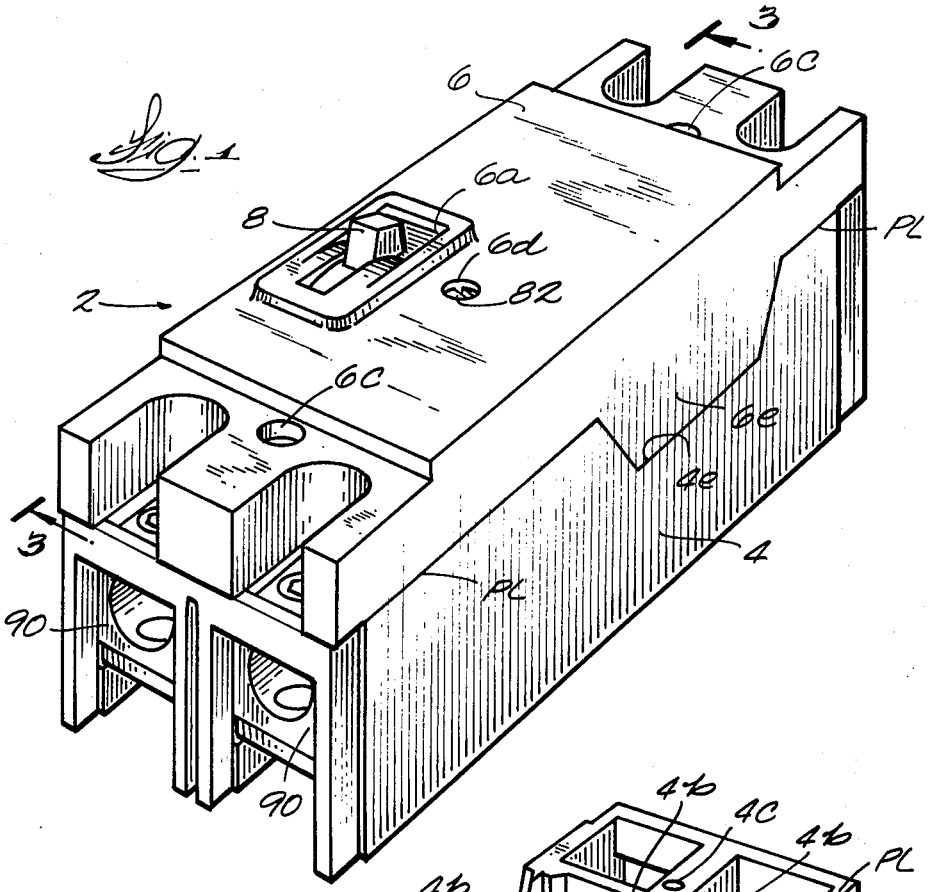
FIG. 1 is a perspective view of a molded case circuit breaker constructed in accordance with this invention.
Figure 2:
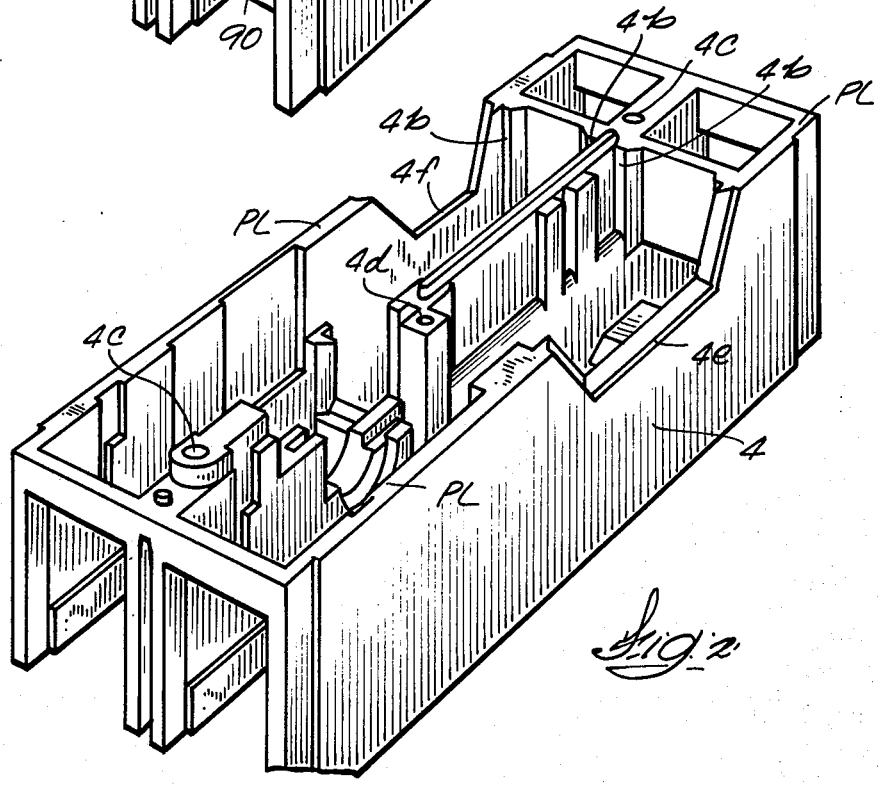
FIG. 2 is a perspective view of the molded base for the circuit breaker shown in FIG. 1.

The molded case circuit breaker 2 of this invention is shown pictorially in FIG. 1. While not intended to be limited thereto, the breaker of this invention is particularly suited for residential and commercial frame application wherein the molded case has a lower profile than similar breakers of industrial frame size. The lower profile is accomplished through an improved contact structure and flux amplifier as will become apparent hereinafter. Breaker 2 may be seen to comprise a molded insulating base 4 and a molded insulated cover 6 joined together along a substantially planar parting line PL. The cover 6 is provided with an opening *6a* through which a handle 8 of an internal operating mechanism projects for external manual operation of the circuit breaker contacts between open and closed positions as will become more apparent hereinafter.

Figure 3:
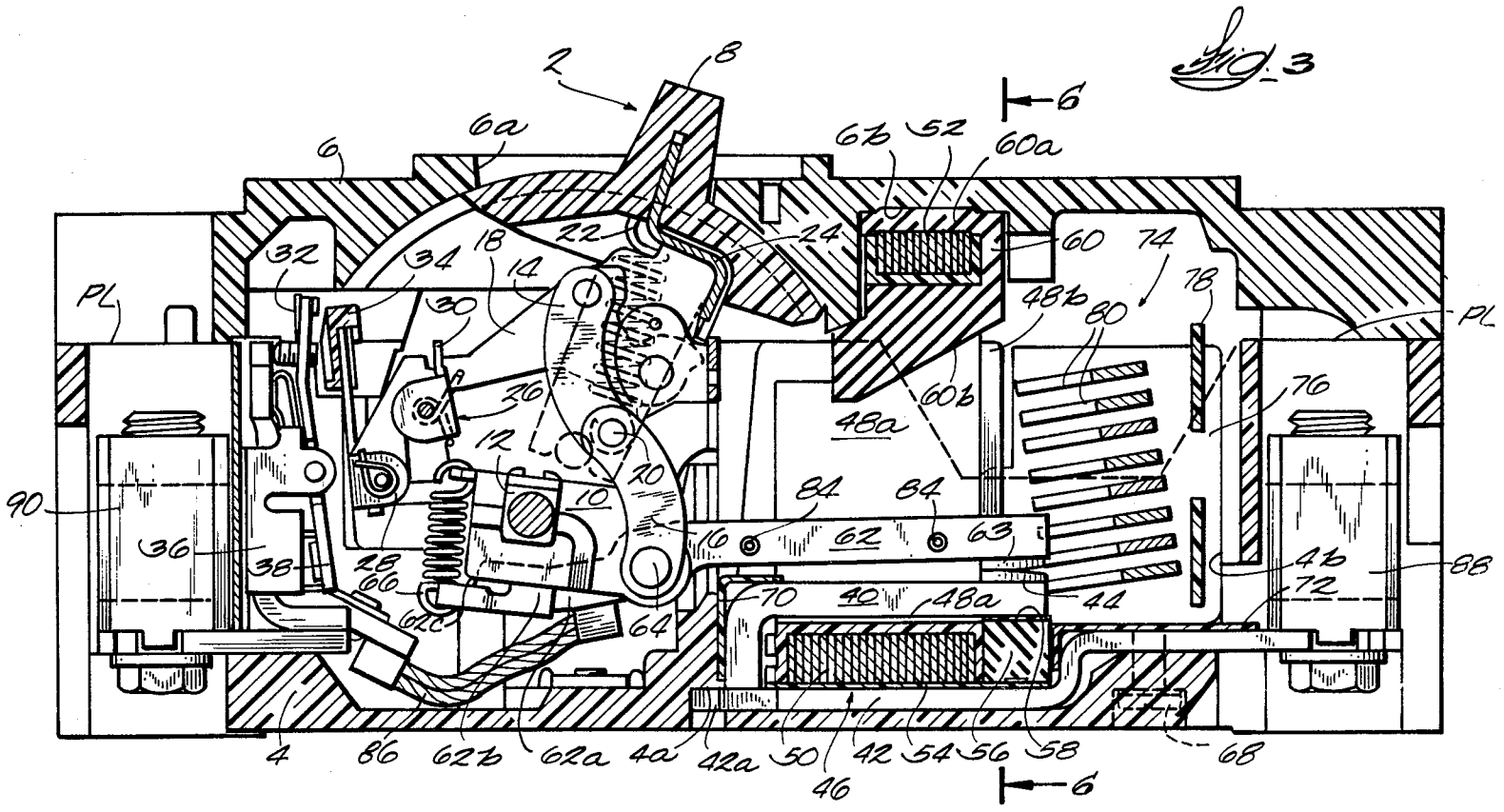
FIG. 3 is a longitudinal cross-section view of a pole containing the operating mechanism for the circuit breaker of this invention taken substantially along the line 3—3 in FIG. 1.

With reference to FIG. 3, the circuit breaker 2 disclosed herein contains an operating mechanism which is substantially identical to that disclosed in U.S. Pat. No. 3,849,751 issued Nov. 19, 1974 to Donald A. Link and Fred H. Williams and assigned to the assignee of this invention. The disclosure of the aforementioned patent is incorporated herein by reference. The operating mechanism is located in only one pole of the breaker in accordance with well known practice and includes a movable contact carrier 10 secured to a transversely extending operating shaft 12 rotatably journaled within base 4. An over center toggle linkage comprising upper links 14 and lower links 16 is connected at its lower end to the movable contact carrier 10 and at its upper end to a latch lever 18 which is pivotally mounted within base 4. The links 14 and 16 of the toggle are joined at the knee thereof by a pin 20 which has the lower ends of a pair of helical tension springs 22 connected thereto, the upper ends of those springs being connected to a handle lever 24. A double acting latch system 26 is provided to restrain the free end of the latch lever 18. The latch system 26 includes a primary latch 28 pivotally mounted within the breaker housing base 4 which operates on a secondary latch 30 also pivotally mounted within the breaker housing base 4 and which directly engages the latch lever 18. With the latch lever 18 restrained by latch system 26, the handle lever 24 is pivotally operable to the left (as viewed in FIG. 3) to carry the upper end of the springs 22 over center of the line of action for the toggle linkage to cause the linkage to collapse, thereby pivoting the movable contact carrier 10 and shaft 12 counter-clockwise. Movement of handle lever 24 back to the right-hand position shown in FIG. 3 carries the upper end of the springs 22 over center of the line of action for the toggle linkage, thereby causing the linkage to straighten and to pivot the movable contact carrier 10 and shaft 12 in a clockwise direction about the shaft axis to the contact closed position.

The circuit breaker mechanism further includes overcurrent sensing means in each pole for operating the circuit breaker contacts to their open condition upon overload currents of first and second degrees of magnitude. A bimetal sensing element 32 is provided in each pole of the breaker for detecting overload currents of a first degree of overload magnitude. Heat generated by such currents cause the bimetal element 32 to warp to the right as viewed in FIG. 3, and to engage a common trip bar 34 affixed to primary latch 28 within the mechanism pole and extending into adjacent poles for releasing the primary and secondary latches and the latch lever 18. The released latch lever 18 then pivots clockwise about its right-hand end to carry the upper end of the toggle linkage over center of the operating springs 22, thereby causing the toggle linkage to collapse and pivot the movable contact carrier 10 and shaft 12 counter-clockwise to the contact open position. Overload currents of a second degree of magnitude, greater than the first degree currents described above, are sensed by an electromagnetic core 36 disposed around a current carrying conductor, which may be the bimetal element 32, and which attracts a pivotally mounted armature 38 causing the upper end of the armature to engage common trip bar 34 and release the primary and secondary latches and latch lever 18 in the manner aforedescribed to cause collapse of the toggle linkage and movement of the movable contact carrier 10 and shaft 12 to the open contact position.

Figure 5:
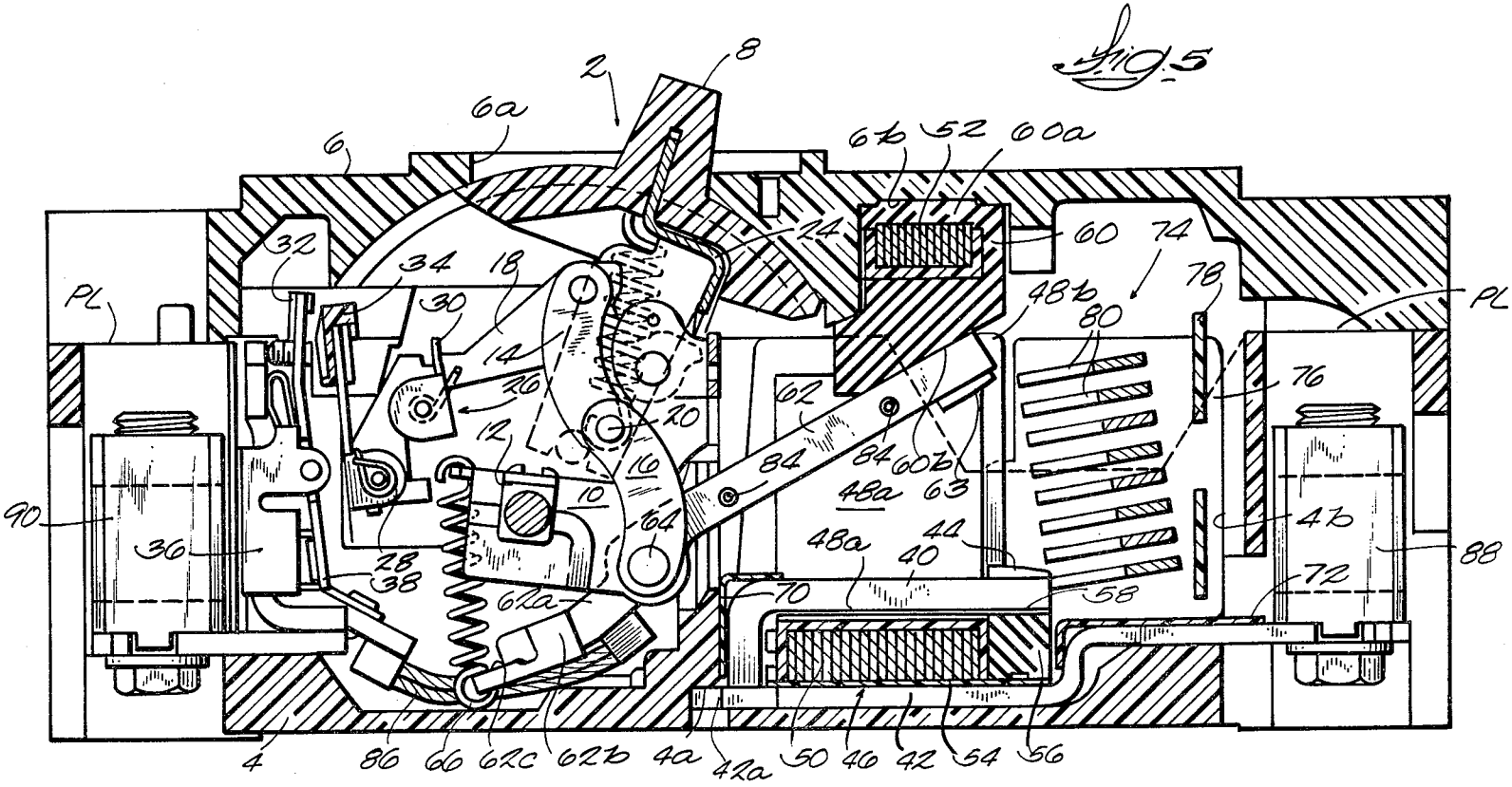
FIG. 5 is a view similar to FIG. 3 showing the movable contact operated to an open position under high fault current conditions.

Circuit breaker 2 is constructed to further respond to overload current conditions of a third magnitude which is greater than the above described overload currents. To this end, contacts are provided which quickly separate directly in response to these overload currents independently of the bimetal or electromagnetic overload sensing means and latch system of the operating mechanism of the circuit breaker. Accordingly, a stationary contact support, or finger 40 is provided on the ON side, or right-hand terminal connector plate 42 of the circuit breaker (see FIGS. 3, 5, and 9). Connector plate 42 is essentially an elongated flat plate having the right-hand end thereof offset or stepped upwardly with respect to the orientation shown in the drawings. Contact finger 40 is an L-shaped member attached to the left-hand end of connector plate 42 by welding, brazing or similarly securing the end of its shorter leg to connector plate 42 whereby the longer leg of finger 40 extends along the connector plate 42 toward the offset step portion and in spaced parallel relation to the left-hand end of the connector plate. A stationary contact element 44 is affixed to the free end of the longer leg of finger 40 by welding, brazing or the like. As shown in FIG. 9, the longer leg of contact finger 40 initially extends angularly away from the connector plate 42 at the free end thereof for reasons that will be described later.

A magnetic flux amplifier 46 is provided in conjunction with the contact structure of circuit breaker 2. Flux amplifier 46 comprises a molded insulating housing 48 having a vertically elongated central aperture **48*a* therein. A plurality of U-shaped laminations 50 formed of magnetic steel or the like are assembled over the exterior of housing 48 from the lower end thereof such that the legs of the laminations extend upwardly along the elongated sides of aperture 48*a*. A second plurality of U-shaped laminations 52 are assembled to housing 48 from the upper end thereof such that the legs of the laminations 52 extend downwardly toward laminations 50. The free ends of the legs of the respective laminations 50 and 52 are in corresponding alignment to abuttingly engage each other at the sides of housing 48. As seen best in FIG. 9, the legs of laminations 50 are longer than the legs of laminations 52 and the point of abutting engagement for the respective laminations is therefore nearer the upper end of housing 48. It may also be seen that the lower set of laminations 50 includes a greater number of laminations than are contained in the upper set in view of space constrictions within the upper portion of circuit breaker 2 while maximizing the length of the flux amplifier in the current-carrying direction of the contact support member 40. Although the upper laminations 52 do not abut the lower laminations 50** on a one-for-one basis, they do effectively magnetically complete a closed loop path for all of the lower laminations.

Flux amplifier 46 is assembled to connector plate 42 such that stationary contact finger 40 projects through the lower end of central aperture **48*a*. A channel-shaped teflon insulator 54 is disposed between the lower set of laminations 50 and the connector plate 42 to insulate these members. An energy absorbing elastomer cushion 56 having an arc resistant pad 58 secured to the upper surface thereof is positioned on the insulator 54 below the free end of stationary contact finger 40. When the aforementioned parts are thus assembled, stationary contact finger 40 is bent downwardly within the central aperture 48*a* to attain a final, calibrated position for stationary contact 44 with respect to connector plate 42. When in the final position, stationary contact finger 40 traps insulator 54 against plate 42 and cushion 56 against insulator 54. Additionally, the space between the free end of finger 40 and the offset step portion of plate 42 is reduced to prevent removal of flux amplifier 46 from plate 42. Mechanical shock forces imparted to stationary contact 44 and finger 40 upon closure of movable contact 63 thereon are absorbed by energy absorbing elastomer cushion 56, thereby to reduce oscillations in the contact support members and consequently reducing the potential for contact bounce and contact welding. The upstanding offset step portion of plate 42 cooperates with cushion 56 to maintain flux amplifier 46** positioned toward the lefthand end of the connector plate.

A C-shaped energy absorbing elastomer cushion 60 is assembled over the upper end of flux amplifier 46 such that an upper leg 60*a* of cushion 60 overlies the laminations 52 and the opposite, lower leg 60*b* thereof enters the upper end of central aperture 48*a* of housing 48. Leg 60*b* is formed in a triangular shape whereby the angular lower surface of leg 60*b* coincides with the angular position of a movable contact arm of the circuit breaker in the open circuit position. Cushion 60 aids in retaining upper laminations 52 to the flux amplifier 46 prior to assembly of the connector plate 42 and aforementioned attached parts into breaker base 4.

Figure 4:
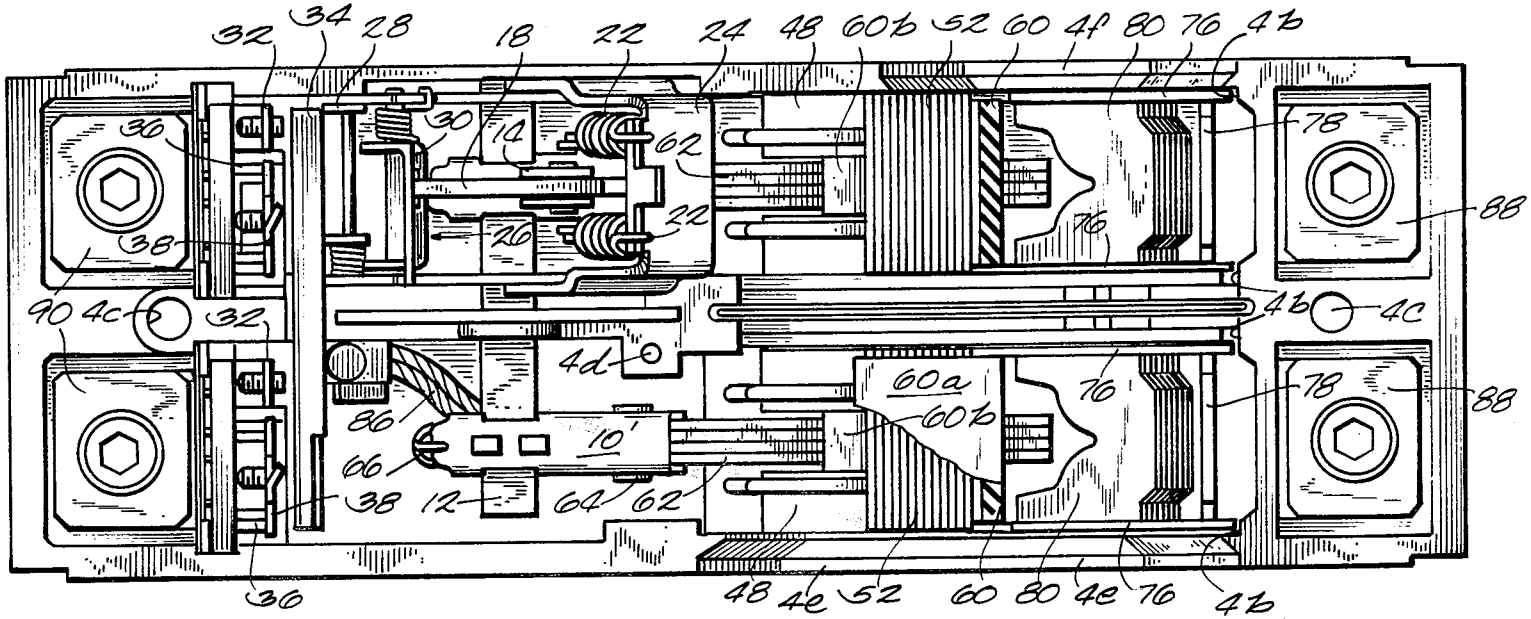
FIG. 4 is a plan view of the circuit breaker shown in FIGS. 1 and 3 with the cover removed therefrom.

A movable contact arm 62 is pivotally mounted to the movable contact carrier 10 by a pin 64 which, in the pole containing the operating mechanism, extends through the lower link 16 of the toggle linkage, the movable contact carrier 10 and the movable contact arm 62. In a multipole breaker having an outboard pole such as the lower pole shown in FIG. 4, shaft 12 projects into the adjacent pole and has a contact carrier 10' rigidly clamped thereto. Since the outboard poles do not contain the toggle linkage for the operating mechanism, the pin 64 passes only through the contact carrier 10' and the respective movable contact arm 62 in these poles. Movable contact arm 62 has an extension 62*a* projecting to the left of its pivotal attachment with carrier 10 which has a clip 62*b* (see FIG. 8) attached thereon. A helical coil tension spring 66 connects the outer extremity of clip 62*b* with movable contact carrier 10 or 10' to provide contact arm 62 with a clockwise bias about the pivot pin 64 as viewed in FIGS. 3 and 5. Clockwise movement of arm 62 with respect to carrier 10 or 10' is limited by engagement of clip portions 62*c* with the lower edges of carrier 10 or 10'. Under normal operating conditions, spring 66 biases the clip firmly into engagement with the carrier so that movable contact arm 62 moves integrally with carrier 10 between open and closed positions. A movable contact element 63 is secured to the right-hand end of arm 62 as will be described more fully hereinafter.

The subassembly comprising connector plate 42, stationary contact finger 40 and flux amplifier 46 is inserted into circuit breaker base 4 as a unit, positioning the central aperture 48*a* of housing 48 over movable contact arm 62. Connector plate 42 is provided with a tab 42*a* projecting from the left-hand end thereof which engages a cavity 4*a* in the base for retaining that end of the subassembly within the base. A screw 68 (FIG. 3) projects upwardly from the bottom of base 4 through a clearance hole in the base to threadably engage a hole 42*b* in the offset right-hand end of connector plate 42 to secure the connector plate and its subassembly to the breaker housing. An L-shaped teflon insulator 70 is disposed between the short leg of the stationary contact finger 40 and a portion of the base 4 and extends over a portion of the finger 40 to provide insulation between the movable contact arm 62 and the stationary contact finger 40. An L-shaped fibre board insulator 72 is disposed over the offset stepped portion of connector plate 42 with the short leg of the insulator 72 extending between the offset portion and the cushion 56.

An arc extinguishing structure, or arc chute 74 is provided at the right-hand end of the base 4. The arc chute 74 comprises a pair of fibre board side plates 76 which are slotted to receive fibre board end plates 78 therebetween and a plurality of U-shaped metallic arc plates 80 arranged in spaced stacked relationship along the path of travel of the movable contact 63. Side plates 76 of arc chute 74 rest upon the insulator 72 and the left-hand ends of side plates 76 engage housing 48 on outboard sides of a pair of ribs 48*b* formed on the housing. The arc chute 74 is longitudinally positioned within base 4 by the housing 48 and by vertical shoulders 4*b* in base 4.

Cover 6 is assembled onto the upper ends of the sidewalls of the molded case to overlie the breaker mechanism, the handle 8 projecting through the opening 6*a* in the cover. Cover 6 has recesses 6*b* formed therein which receive the upper leg 60*a* of C-shaped cushion 60 to position the upper end of flux amplifier 46. Cover 6 is secured to base 4 by tubular rivets, or grommets (not shown) which extend through holes 6*c* in cover 6 and aligned holes 4*c* in base 4 and are spun over at the ends and by a screw 82 (FIG. 1) which passes through a hole 6*d* in the cover and an aligned hole 4*d* in base 4 to receive a nut (not shown) at the bottom of the base. When cover 6 is secured to base 4, it compresses upper leg 60*a* of cushion 60 upon the flux amplifier 46 and biases the flux amplifier firmly against the connector plate 42 and the bottom of base 4.

The sidewalls of base 4 are recessed at 4*e* and 4*f* in the area of the contacts 44, 63 and the arc extinguishing structure 74 to lower the parting line between the cover 6 and base 4 to a plane which is nearly equidistant between the bottom wall of the base and the top wall of the cover. Similarly, the cover 6 is provided with depending extensions 6*e* and 6*f* of its sidewalls which are formed complementally to the respective recesses 4*e*, 4*f* to mutually engage the base sidewalls in the recessed area. With reference particularly to FIG. 6, it may be seen that the parting line edges of the sidewalls of the respective base and cover members are beveled in the area of the respective recesses and complemental extensions such that the cover extensions 6*e*, 6*f* overlie the recess 4*e*, 4*f* sidewalls on the exterior surface of the molded housing. This construction provides improved strength for the housing in the area of contact separation and arc generation, thereby enabling the housing to withstand the forces created by the arc gas. It will be appreciated that the strength of the sidewalls of the base 4 in the transverse outward direction decreases as the distance thereof from the bottom wall of the base increases. Inasmuch as the cover 6 is shallower in height than the base 4 and its sidewalls thicker than those of base 4 as seen in FIG. 6, the strength of the sidewalls of the base 4 at the normal parting line PL is less than that for the sidewalls of the cover 6 at that same location. By lowering the parting line in this area to a plane closer to the bottom wall of the base 4, the strength of the base sidewalls at the relocated parting line is increased. When. the relocated parting line is positioned approximately midway between the upper and lower walls of the insulating housing the strength of the sidewalls for the base and the cover become more nearly equal. Moreover, the relocated parting line also functions to reapportion the sidewall surface area of the cover and base in the contact separation area wherein the internal pressure acting on these surfaces results in a more equalized distribution of forces on the base and cover members. The overlapping beveled relationship of the cover extensions 6*e*, 6*f* to the sidewalls of the base in this area function to transfer outward forces on the sidewalls of the base to the thicker, stronger sidewalls of the cover member.

The movable contact arm 62 is separately shown in FIG. 8 and may be seen to comprise four laminations initially secured together by a pair of spring pins 84 inserted within aligned holes in each of the laminations. It is a preferred practice to manufacture such contact arms by "blanking" whereby the desired shape is sheared from a sheet of material stock. This process provides the blanked part with a rounded edge at the point of initial engagement with the shearing tool, a cut true edge for approximately one-third of the material thickness and a rough receding break for the balance of the thickness. If the item to be blanked is relatively thick, such as a one-piece movable contact arm 62' illustrated in FIG. 7*a* and constructed to handle currents of the magnitude seen by breaker 2, the rough receding break surface is proportionately large. A contact element such as 63', intended to be welded, brazed, soldered or the like to this cut surface, has approximately one-third of its width secured to the true edge. This construction introduces alignment problems for the contact element in that it may be canted during assembly, and the resulting gap between the contact and the receding edge does not fill with the solder or similar material. By providing four separately blanked movable contact laminations secured together as illustrated in Fig. 7*b*, the cut true surface provided by the individual blanking operation on each of these laminations is distributed across the width of the assembled laminations comprising the movable contact arm 62, thereby providing four spaced points at which the movable contact 63 may be securely fastened to true edges of the movable contact arm 62 while still employing the preferred economical blanking process in forming the parts. This construction not only provides for improved alignment of the contact element, but also provides smaller gaps with the contact at the receding edges of the individual laminations which readily fill with the solder or similar material. This same feature holds true near the other end of the contact arm wherein a flexible braid connector 86 is similarly welded, soldered or brazed to the movable contact arm 62 at the left-hand extension 62*a* of the movable contact arm, and for a hole 62*d* (FIG. 8) wherein a wider true bearing surface may be provided for the pivot pin 64.

The effectiveness of a flux amplifier for amplifying the flux and the electromagnetic forces generated by the currents in the contact members is directly related to the width of the aperture or slot of the flux amplifier. As the width of the slot decreases, the effectiveness of the flux amplifier increases. Accordingly the contact structure of this invention can be readily modified to increase the effectiveness of the flux amplifier by reducing the width of the movable contact arm, thereby enabling the flux amplifier slot to be narrowed. As shown in FIG. 9, shorter outboard laminations 62''*e* are provided for a modified movable contact arm 62'' adjacent the left-hand end thereof and through the point of pivotal attachment to the movable contact carrier 10 to maintain a wide pivot bearing surface for the arm. Only the central two laminations for the movable contact arm 62'' extend into the central aperture of the flux amplifier, thereby substantially reducing the contact arm width and enabling the width of the slot to be correspondingly reduced without effecting related parts of the circuit breaker.

In operation, the circuit breaker 2 is connected in an electrical circuit such that current enters the breaker through an ON side terminal lug 88 attached to connector plate 42, travels through the longer leg of stationary contact finger 40 in a right-hand direction, passes between the stationary contact 44 and movable contact 63 and travels through the movable contact arm 62 in the left-hand direction, through the flexible braid connector 86 into the bimetal and magnetic overcurrent sensing means 32 and 36, 38, respectively, and outward through an OFF side terminal lug 90 at the lefthand end of the breaker. Upon high fault current conditions of the aforedescribed third magnitude, the parallel, oppositely directed current paths in the stationary contact finger 40 and the movable contact arm 62 generate repelling electromagnetic forces between these two members which tend to separate the members. Inasmuch as the stationary contact finger 40 is essentially fixed with respect to the breaker and its mechanism, the force operating on the movable contact arm 62 pivots it independently of the contact carrier 10 and the operating mechanism about the pivot pin 64. The flux amplifier 46 amplifies the flux and the electromagnetic forces so generated, thereby operating to increase the speed at which the movable contact arm separates from the stationary contact finger. The magnetically closed loop of the flux amplifier increases the force applied between the contact members for higher current values than are achieved by an open magnetic member.

Upward movement of the movable contact arm 62 is arrested by its engagement with leg 60*b* of C-shaped cushion 60. The upper end of flux amplifier 46 functions as the primary reaction surface for cushion leg 60*b* in absorbing forces imparted to it by the momentum of movable contact arm 62. The amount of flux generated in flux amplifier 46 and the resulting electromagnetic forces are directly proportiohal to the current in the contact members and increased flux in the flux amplifier increases the attractive holding force between laminations 50 and 52. Accordingly, the same factors which increase the momentum of movable contact arm 62 function to increase the ability of the self-contained magnetic system of the flux amplifier 46 to arrest that momentum. Although some force from the movable contact arm may be transmitted through the upper end of the flux amplifier 46 to cover 6 through upper leg 60*a* of cushion 60, and directly to cover 6 by an extension of lower leg 60*b*, the major portion of the mechanical shock forces associated with stopping the movable contact arm 62 is received by the upper end of the flux amplifier and potential damage to the cover 6 is minimized.

During the aforedescribed independent movement of movable contact arm 62 to the upper end of aperture 48*a*, the magnetic overcurrent sensing means 36, 38 of the circuit breaker operating mechanism functions to trip the common trip bar 34 and release the primary and secondary latches 28 and 30, respectively, to release the latch lever 18 and cause the operating mechanism toggle linkage to collapse. This operation causes the movable contact carrier 10 to pivot to the open position before the contacts 44, 63 can reclose under the influence of spring 66 when the current goes to zero. In the magnetically tripped condition of the breaker mechanism the movable contact arm 62 comes to rest against the leg 60*b* of cushion 60.

During contact separation an electric arc drawn between the contacts 44 and 63 is directed into the arc chute structure 74 and extinguished thereby. Gases produced by the arc are vented through suitable passageways in the right-hand end of the breaker and within the interior of the breaker housing. Under high fault current conditions when the movable contact arm 62 operates independently of the breaker operating mechanism to separate the contacts 44 and 63 at high speed, the arc is rapidly lengthened to quickly raise its voltage. The internal pressures developed by the resulting arc gasses are absorbed by the improved housing structure hereinbefore described without damage to the housing sidewalls.

It will be appreciated that the invention described in the foregoing provides a circuit breaker having several advantages. An improved magnetic flux amplifier permits a contact structure which can be situated low in the breaker housing to provide a low profile breaker suitable for use in residential and commercial panelboards as a service entrance main breaker. The flux amplifier further provides a reaction surface for arresting the opening movement of the movable contact independently of the breaker housing wherein the strength of the reaction surface increases in proportion to forces propelling the movable contact under high fault current conditions. The contact structure is specifically arranged to enable economical fabrication and assembly methods to be employed. Improvements to the molded case for the breaker increase the strength of the sidewalls in the contact separation area. While a preferred embodiment of the invention has been disclosed, it is to be understood that it is susceptible of various modifications without departing from the scope of the appended claims.

We claim:

1. A circuit breaker comprising, in combination:

an insulating housing;

elongated stationary contact support means disposed in said housing and having a stationary contact at one end;

a movable contact carrier rotatably supported in said housing;

an elongated movable contact arm attached to said carrier for pivotal movement relative to said carrier and having a moveable contact at one end;

means biasing said movable contact arm for integral rotary movement with said carrier;

operating means for manually operating said carrier to open and closed positions, said movable contact arm being disposed substantially parallel to and co-extensive with said stationary contact support means in the closed position;

means connecting said stationary contact support means and said movable contact arm in an electric circuit for effecting current flow in opposite directions therein when said contacts are in said closed position wherein currents in said stationary contact support means and said movable contact arm greater than a predetermined value generate electromagnetic forces for effecting pivoting movement of said movable contact arm relative to said carrier and away from said stationary contact support means for separating said contacts; and flux amplifier means forming a magnetically closed loop around said stationary contact support means and said movable contact arm for amplifying said electromagnetic forces.

2. The invention as defined in claim 1 wherein said flux amplifier means comprises a magnetic device having a central aperture defined by a continuous wall within said device, said aperture being elongated in the direction of movement of said movable contact arm.

3. The invention as defined in claim 2 wherein said continuous wall adjacent one end of said elongated central aperture comprises stop means for said movable contact arm when moving from the closed contact position.

4. The invention as defined in claim 2 wherein said magnetic device comprises an insulating member having a plurality of magnetizable laminations positioned thereon.

5. The invention as defined in claim 4 wherein said laminations are U-shaped members disposed over said insulating member from opposite directions whereby the free ends of the legs of the respective laminations are in aligned mating engagement.

6. The invention as defined in claim 5 wherein the legs of said U-shaped laminations disposed over said insulating member from one direction are longer than the legs of said U-shaped laminations disposed over said insulating member from the other direction whereby said mating engagement of said free ends is offset from a central plane of said elongated aperture.

7. The invention as defined in claim 6 wherein a greater number of laminations are disposed over said insulating member from said one direction than are disposed over said insulating member from said other direction.

8. The invention as defined in claim 5 wherein one end of said elongated central aperture comprises stop means for arresting opening movement of said movable contact arm and electromagnetic flux established in said magnetic device in response to said currents generates electromagnetic forces in said magnetic device which cause said laminations inserted from one direction to be attracted to said laminations inserted from the other direction, said last mentioned forces increasing in proportion to said force effecting pivoting movement of said movable contact arm.

9. The invention as defined in claim 2 wherein said stationary contact support means comprises a contact finger supported at one end on a connector member and extending through said magnetic device central aperture in spaced relation to said connector member whereby a portion of said magnetic device is disposed between said finger and said connector member.

10. The invention as defined in claim 9 wherein said magnetic device comprises stop means at an end of said elongated central aperture opposite the end thereof adjacent said stationary contact finger for arresting contact opening movement of said movable contact arm.

11. The invention as defined in claim 10 wherein said stop means comprises an energy absorbing cushion member disposed adjacent said end of said aperture.

12. The invention as defined in claim 11 wherein said cushion member extends beyond said magnetic device to be disposed adjacent said insulating housing for distributing the forces associated with arresting movement of said movable contact arm to said magnetic device and said insulating housing.

13. The invention as defined in claim 10 wherein said housing comprises abutment means engaging said magnetic device at an outer surface thereof adjacent the end of said elongated central aperture having said stop means for holding said magnetic device firmly against said connector member.

14. The invention as defined in claim 13 wherein energy absorbing cushion means are interposed said housing abutment means and said magnetic device for cushioning said engagement.

15. The invention as defined in claim 14 wherein said energy absorbing cushion means comprises a substantially C-shaped member disposed over said magnet device, one leg of said C-shaped member being interposed said housing abutment means and said magnetic device and the other leg being disposed in said elongated central aperture for engagement by said movable contact arm.

16. The invention as defined in claim 9 wherein said connector means comprises offset means projecting toward said contact finger, said offset means being positioned linearly beyond the position of said magnetic device when assembled thereto for limiting linear movement of said device along said connector, said contact finger being initially formed angularly away from said connector member to provide clearance between said contact finger and said connector member at said offset means to permit assembly of said magnetic device to said stationary support means, said contact finger being deformed within said central aperture toward said connector member subsequent to assembly of said magnetic device to said stationary support means to restrict movement of said magnetic device toward said contact finger to an amount less than the projection of said offset means, thereby also restricting linear movement of said magnetic device along said connector member.

17. The invention as defined in claim 16 further comprising resilient means interposed said magnetic device and said offset means for restricting linear movement of said magnetic device along said connector member, said resilient means being trapped against said connector member by said contact finger.

18. The invention as defined in claim 17 wherein said connector comprises a tab extending from said one end and said housing comprises a recess complementally engaging said tab for securing said one end of said connector within said housing, and fastener means for securing the other end of said connector to said housing.

19. The invention as defined in claim 2 wherein said movable contact arm comprises a plurality of laminations secured together in electrical integrity and said movable contact spans said laminations and is affixed to each of said laminations.

20. The invention as defined in claim 19 wherein said means connecting said movable contact arm in said electric circuit comprises a flexible connector having one end thereof spanning said laminations and affixed to each of said laminations.

21. The invention as defined in claim 2 wherein said movable contact arm comprises a plurality of laminations, outboard ones of said laminations being shorter than inner ones of said laminations, said inner ones of said laminations being disposed within said central aperture of said magnetic device and said outboard ones of said laminations terminating exteriorly of said magnetic device.

22. The invention as defined in claim 9 further comprising an energy absorbing cushion engaging said contact finger at the unsupported end thereof and on a side opposite said stationary contact for damping contact separating oscillations in said finger and said arm upon closure of said movable contact on said stationary contact.

* * * * *